US011297407B2

(12) United States Patent
Lim et al.

(10) Patent No.: US 11,297,407 B2
(45) Date of Patent: Apr. 5, 2022

(54) EARSET HAVING INNER MICROPHONE

(71) Applicant: EM-TECH Co., Ltd., Gyeongsangnam-do (KR)

(72) Inventors: Dong Wook Lim, Gyeonggi-do (KR); Young In Yoo, Seoul (KR); Je Tae Lee, Gyeonggi-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 16/808,781

(22) Filed: Mar. 4, 2020

(65) Prior Publication Data

US 2020/0288227 A1 Sep. 10, 2020

(30) Foreign Application Priority Data

Mar. 5, 2019 (KR) ..... 1020190025120
Oct. 18, 2019 (KR) ..... 1020190129546

(51) Int. Cl.
*H04R 1/08* (2006.01)
*H04R 1/10* (2006.01)

(52) U.S. Cl.
CPC ..... *H04R 1/083* (2013.01); *H04R 1/1016* (2013.01); *H04R 1/1075* (2013.01)

(58) Field of Classification Search
CPC ..... H04R 1/083; H04R 1/1016; H04R 1/1075
USPC ..... 381/122
See application file for complete search history.

(56) References Cited

U.S. PATENT DOCUMENTS 6,567,525 B1 * 5/2003 Sapiejewski ..... H04R 1/1083 381/309
2015/0382100 A1 * 12/2015 Azmi ..... H04R 1/1091 381/380
2016/0302000 A1 * 10/2016 Shin ..... H04R 1/1016

FOREIGN PATENT DOCUMENTS

KR 20160001686 A 1/2016
KR 20160121172 A 10/2016
KR 20170080386 A 7/2017
KR 101762671 B1 8/2017

* cited by examiner

*Primary Examiner* — Vivian C Chin
*Assistant Examiner* — Douglas J Suthers
(74) *Attorney, Agent, or Firm* — Murphy, Bilak & Homiller, PLLC

(57) ABSTRACT

Embodiments described herein provide an earset that has a chamber for effectively blocking external noise, with a sound reproducing unit and an inner microphone mounted in the chamber. According to an embodiment of the earset, the earset includes: a housing having a mounting space in which components are mounted and an insertion tube that is inserted into an external auditory canal of the user; a sound reproducing unit mounted in the mounting space and configured to emit sounds to the insertion tube; an inner microphone mounted in the mounting space; a chamber forming a closed space that surrounds the inner microphone; and a duct mounted in the chamber and configured to transmit sounds coming through the insertion tube to the inner microphone.

6 Claims, 7 Drawing Sheets

EARSET HAVING INNER MICROPHONE

TECHNICAL FIELD

Embodiments described herein relate to an earset, and more particularly, to an inner microphone capable of transmitting sounds heard from a user's ear and an earset having the inner microphone.

BACKGROUND

Generally, an earset is a piece of equipment that combines an earphone with a microphone, for sending and receiving audio signals, which is connected with wires or wirelessly to an electronic device. The earset is usually equipped with a sound reproducer that is inserted into a user's ear and a microphone that is fitted as close to the user's mouth as possible, for transmitting sounds emitted by the user. Such a configuration is problematic in that external noise intrudes into the microphone in a noisy environment, and that, when the user moves their body, the microphone will judder, thus making it difficult to transmit sound clearly.

To solve this problem, a technology disclosed in Korean Patent Registration Publication No. 10-1762671 was developed which feeds a user's voice coming through the Eustachian tube in the user's ear into the microphone.

FIG. 1 is a view showing an earset having an inner microphone according to the conventional art. A housing 10 comprises a mounting space 11 in which components are mounted and an insertion tube 12 that is inserted into the external auditory canal. An earbud of elastic material may be detachably attached to the insertion tube 12 so as to fit comfortably in the user's ear. Components including a sound reproducing unit 20 such as a microspeaker, an inner microphone 30 for receiving audio signals of the user, and a control board (not shown) for controlling these components may be mounted in the mounting space 11. The sound reproducing unit 20 emits sound to the insertion tube 12 to direct the sound into the user's ear, and the inner microphone 30 receives the user's voice from the insertion tube 12. To facilitate the mounting of the sound reproducing unit 20 and the inner microphone 30, a bracket 40 is mounted in the mounting space in the housing 10, with the sounding producing unit 20 and the inner microphone 30 assembled on the bracket 40. The bracket 40 corresponds in shape to the housing 10, and comprises a lower housing 41 in which the sound reproducing unit 20 is mounted and a microphone housing 42 mounted on the lower housing 41 at one side of the sound reproducing unit 20. The inner microphone 30 is mounted on the microphone housing 42.

However, the earset according to the conventional art is problematic in that external noise may be still transmitted to the microphone through a back hole 22 intended to make it easy to vibrate a diaphragm provided in the sound reproducing unit 20. For this reason, the back hole 22 in the sound reproducing unit 20 is made small in size, usually 0.04 mm or less. As such, the diaphragm of the sound reproducing unit 20 does not have enough vibration force at low frequencies, which can result in a reduction in sound pressure.

SUMMARY

Embodiments described herein provide an earset capable of preventing external noise from being transmitted through an inner microphone.

According to one embodiment, there is provided an earset having an inner microphone, the earset comprising: a housing that defines a mounting space in which components are mounted, forms the exterior, and has a sound emitting hole; a sound reproducing unit mounted in the mounting space, for emitting sounds; the inner microphone mounted in the mounting space; and a duct mounted in the housing, for transmitting sounds coming through the sound emitting hole to the inner microphone.

In some embodiments, the housing may comprise an insertion tube that is inserted into the external auditory canal and serves as a sound emitting hole.

In some embodiments, the earset may further comprise a chamber forming a closed space that surrounds the inner microphone, wherein the duct may be formed in the chamber to transmit sounds coming through the insertion tube to the inner microphone.

In some embodiments, the chamber may comprise an upper bracket for fixing the inner microphone into the mounting space and a lower bracket that interlocks with the upper bracket to form a space.

In some embodiments, the sound reproducing unit may be mounted between the upper bracket and the lower bracket, and the closed space surrounding the sound reproducing unit and the mounting space for the inner microphone may be separated from each other.

In some embodiments, the housing may have a back hole communicating with the rear of the sound reproducing unit.

In some embodiments, the earset may further comprise one or more brackets mounted between the sound reproducing unit and the housing, for tuning the acoustics.

In some embodiments, the duct may extend into the sound emitting hole.

Embodiments also allow for picking up sounds transmitted from the user's ear more clearly by preventing external noise from entering the sound reproducing unit.

Another advantage of the embodiments described herein is to avoid a muffled sensation caused by a pressure difference by employing an open-type structure in the housing of the earset.

A still another advantage of the embodiments described herein is to prevent external noise from entering the inner microphone by having a chamber for closing off the rear of the inner microphone.

Those skilled in the art will recognize additional features and advantages upon reading the following detailed description, and upon viewing the accompanying drawings.

DETAILED DESCRIPTION

Hereinafter, embodiments will be described in more details with reference to the drawings.

Figure 1:
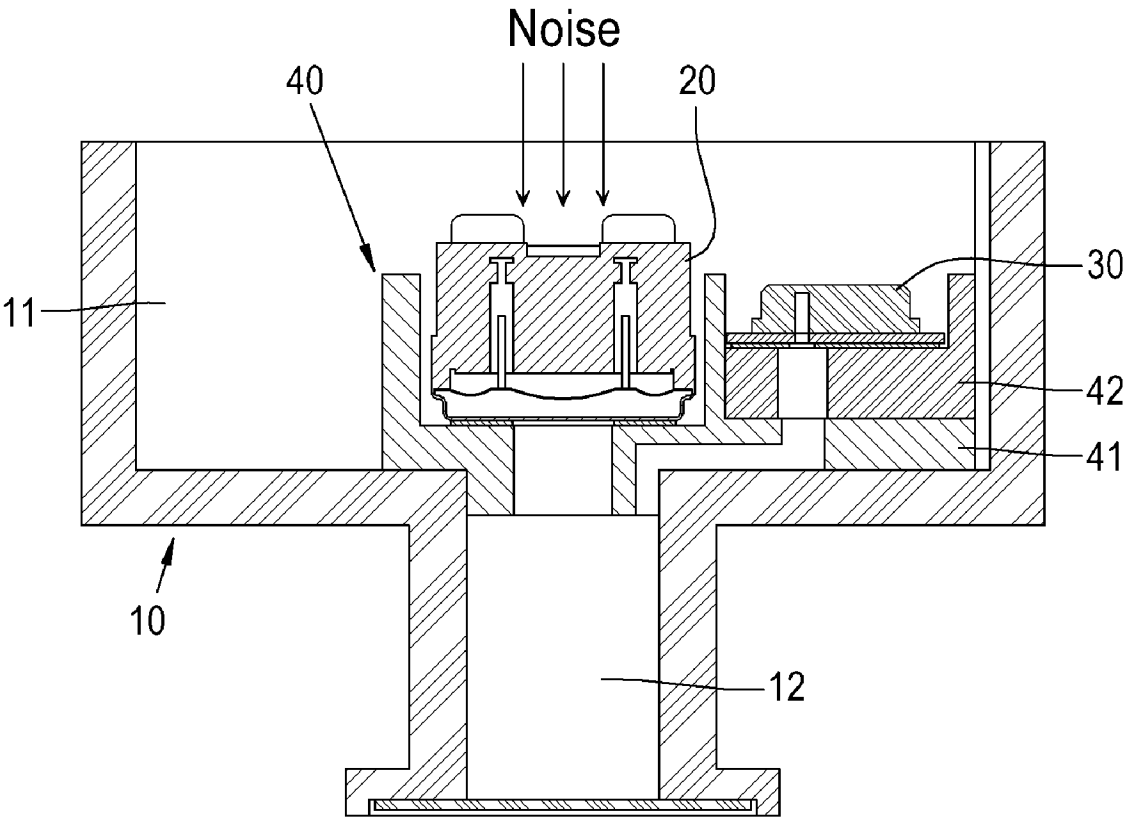
FIG. 1 (PRIOR ART)
FIG. 1 is a cross-sectional view showing an earset having an inner microphone according to the conventional art.
Figure 2:
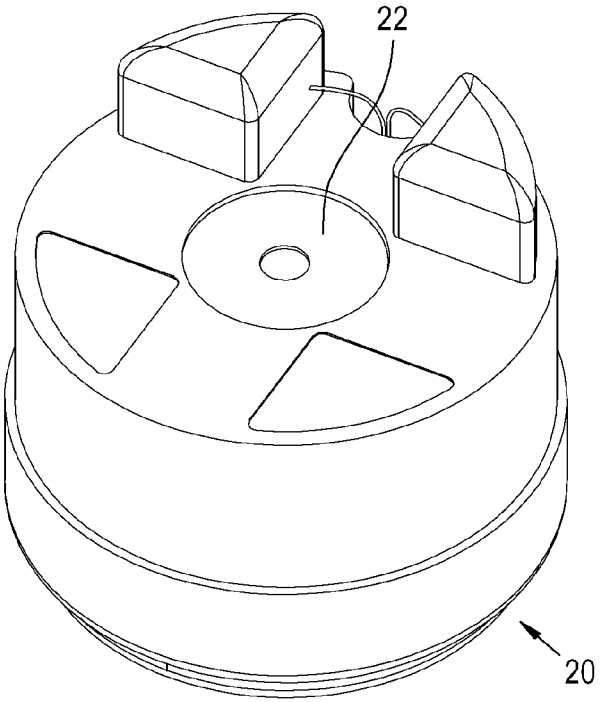
FIG. 2 (PRIOR ART)
FIG. 2 is a perspective view showing the rear of a sound reproducing unit provided in the earset according to the conventional art.
Figure 3:
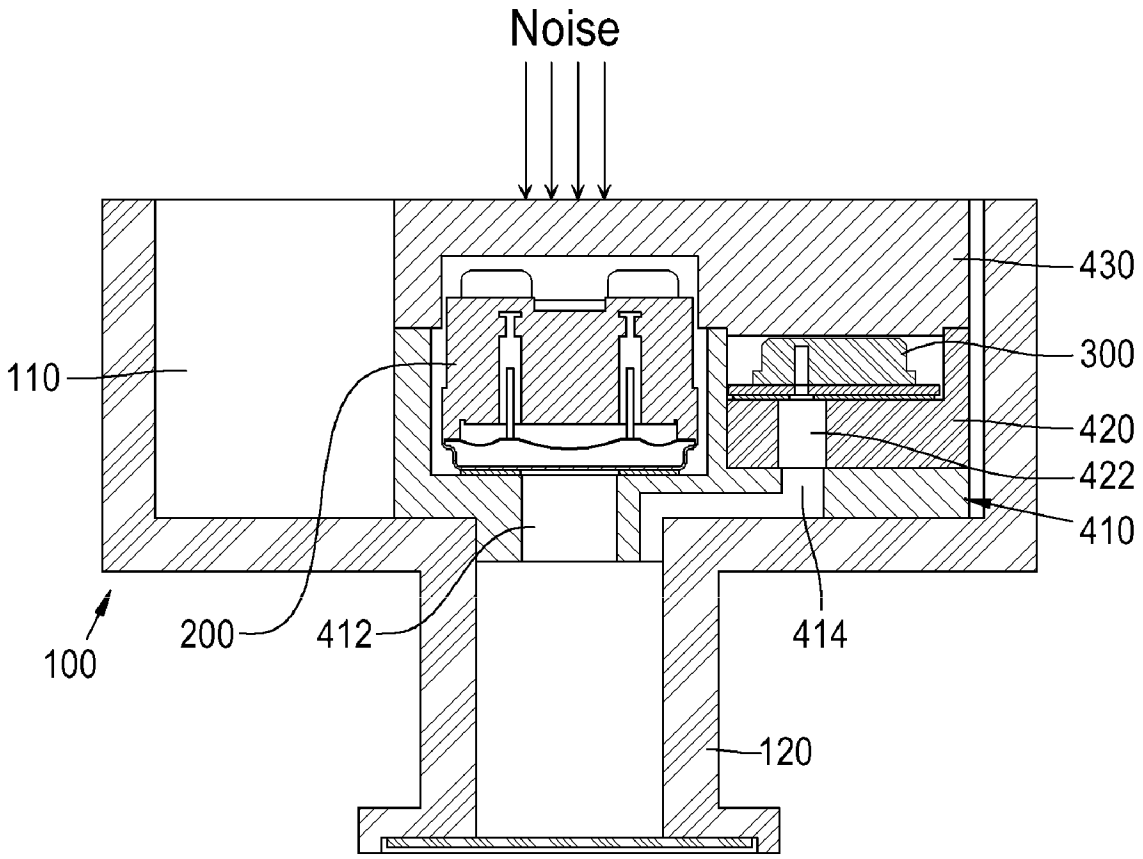
FIG. 3 is a cross-sectional view of an earset having an inner microphone according to a first embodiment.

FIG. 3 is a cross-sectional view of an earset having an inner microphone according to a first embodiment. A housing 100 comprises a mounting space 110 in which components are mounted and an insertion tube 120 that is inserted into the external auditory canal. An earbud of elastic material may be detachably attached to the insertion tube 120 so as to fit comfortably in the user's ear. Components including a sound reproducing unit 200 such as a microspeaker, an inner microphone 300 for receiving audio signals of the user, and a control board (not shown) for controlling these components may be mounted in the mounting space 110. The sound reproducing unit 200 emits sound to the insertion tube 120 to direct the sound into the user's ear, and the inner microphone 300 receives the user's voice from the insertion tube 120. To facilitate the mounting of the sound reproducing unit 200 and the inner microphone 300, they are assembled onto an upper bracket 410, and a lower bracket 430 is attached to the upper bracket 410 to form a closed space 400 for the back volume of the sound reproducing unit 200. Meanwhile, a microphone bracket 420 is added between the upper bracket 410 and the lower bracket 430, and the inner microphone 300 is mounted to the microphone bracket 420.

The upper bracket 410 has a first duct 412 communicating with the insertion tube 120 and connecting to the sound reproducing unit 200 and a second duct 414 connecting to the microphone bracket 420. The microphone bracket 420 also has a duct 422 for connecting the second duct 414 and the inner microphone 300.

In this case, a terminal (not shown) for transmitting an electric signal to the sound reproducing unit 200 and the inner microphone 300 may be added between the microphone bracket 420 and the lower bracket 430. The terminal (not shown) may be connected to a control board (not shown) such as a PCB.

After the upper bracket 410, sound reproducing unit 200, microphone bracket 420, inner microphone 300, terminal (not shown), and lower bracket 430 are assembled, the assembled product is inserted and fixed into the mounting space 110 of the housing 100.

The upper bracket 410 may have a shape corresponding to the shape of the mounting space 110 of the housing 100 to make mounting easy.

Thanks to the closed space 110 formed by the upper bracket 410 and the lower bracket 430, external noise can be blocked without entering through the back hole (not shown) of the sound reproducing unit 200. Therefore, the back hole size of the sound reproducing unit 200 may be increased up to about 1.0 mm, which, in turn, can increase sound pressure by 6 dB or more at low frequencies.

Figure 4:
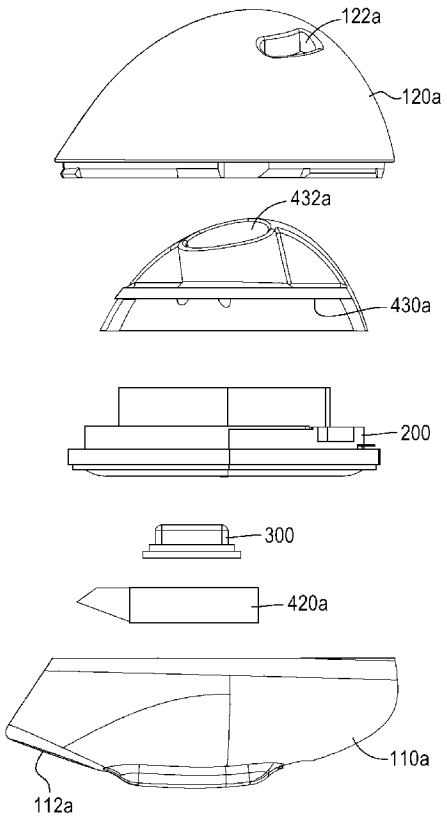
FIG. 4 is an exploded view of an earset according to a second embodiment.
Figure 5:
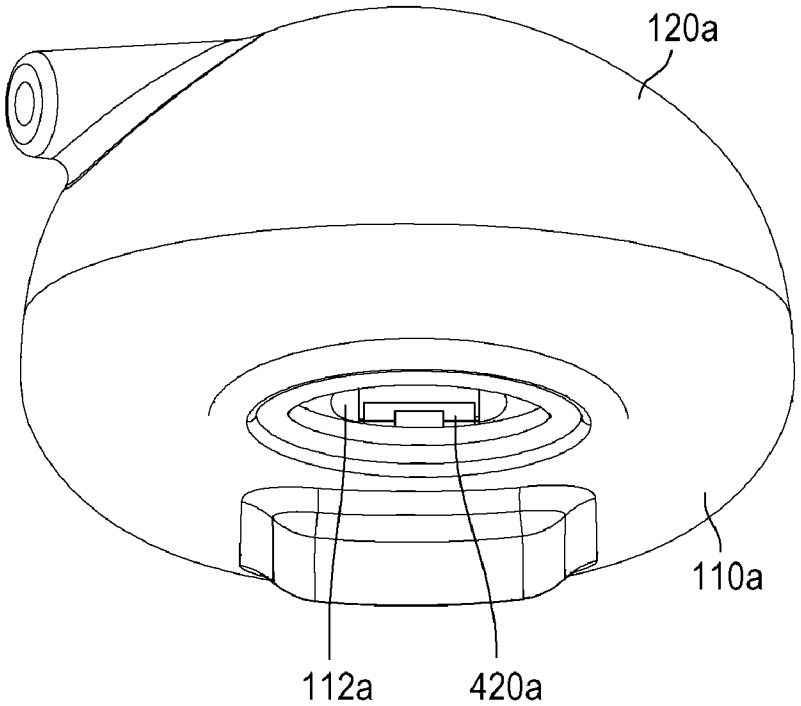
FIG. 5 is a perspective view of the earset according to the second embodiment.
Figure 6:
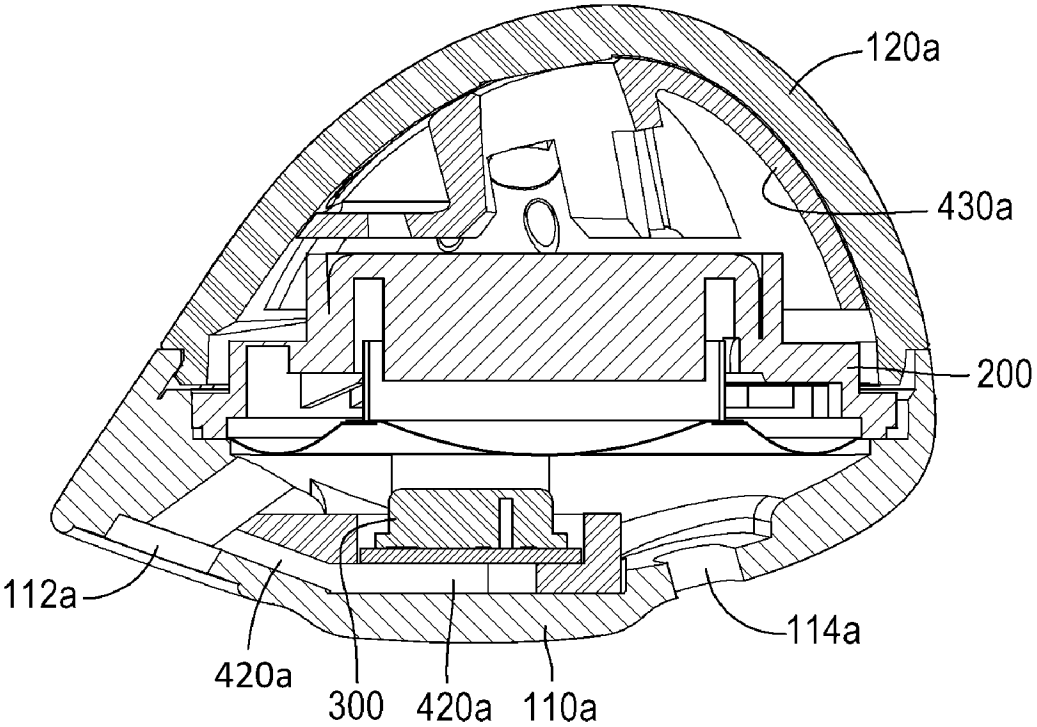
FIG. 6 is a cross-sectional view of the earset according to the second embodiment.

FIG. 4 is an exploded view of an earset according to a second embodiment. FIG. 5 is a perspective view of the earset according to the second embodiment. FIG. 6 is a cross-sectional view of the earset according to the second embodiment.

The earset according to the second embodiment is an open-type earset with a back hole 122*a* formed in a rear housing 120*a*, to which a duct structure is applied to transmit sounds coming through a sound emitting hole to the inner microphone according to a technical feature of the present invention.

The earset according to the second embodiment comprises a front housing 110*a* facing the user's ear and a rear housing 120*a* facing away from the user's ear, and its components are mounted in a mounting space formed by joining the front housing 110*a* and the rear housing 120*a*.

Components including a sound reproducing unit 200 such as a microspeaker, an inner microphone 300 for receiving audio signals of the user, and a control board (not shown) for controlling these components may be mounted in the housings 110*a* and 120*a*.

The front housing 110*a* comprises one or more sound emitting holes 112*a* and 114*a*, and the earset according to the second embodiment has two sound emitting holes 112*a* and 114*a* spaced apart with a predetermined angle between them. The sound emitting holes 112*a* and 114*a* may be divided into a first sound emitting hole 112*a* of relatively large size and a second sound emitting hole 114*a* of relatively small size. The first sound emitting hole 112*a* outputs sounds to the external auditory canal from the sound producing unit 200, and the second sound emitting hole 114*a* is a structure for achieving overall balance in SPL, that serves to tune mid-frequency sound pressure flat and increase high-frequency sound pressure. Preferably, the sound emission angle of the first sound emitting hole 112*a* and the sound emission angle of the second sound emitting hole 114*a* are 90 degrees or more.

The inner microphone 300 receives the user's voice from the first sound emitting hole 112*a*. To this end, a duct 420*a* is provided which communicates with the first sound emitting hole 112*a* and transmits the user's voice to the inner microphone 300. The duct 420*a* is attached to the front housing 110*a*. Thus, when the user utters, the voice entering the first sound emitting hole 112*a* through the Eustachian tube may be transmitted to the inner microphone 300.

As explained previously, the earset has a back hole 122*a* for enabling communication between the inside of the housing and the outside to keep the sound pressure in the ear constant. In this case, a bracket 430*a* may be mounted between the rear housing 120*a* and the sound reproducing unit 200. The bracket 430*a* covers the back hole 122*a* to form the duct. The bracket 430*a* has a communicating hole 432*a* spaced apart from the back hole 122*a* of the rear housing 120*a*, for enabling communication between the inside of the housing and the duct. That is, the duct 420*a* connects the communicating hole 432*a* and the back hole 122*a*. The duct structure formed by the bracket 430*a* serves to produce internal resonance within the housings 110*a* and 120*a* and enhance low-frequency sounds. Moreover, the back hole 122*a* serves to eliminate the dip in the 2 kHz range.

Figure 7:
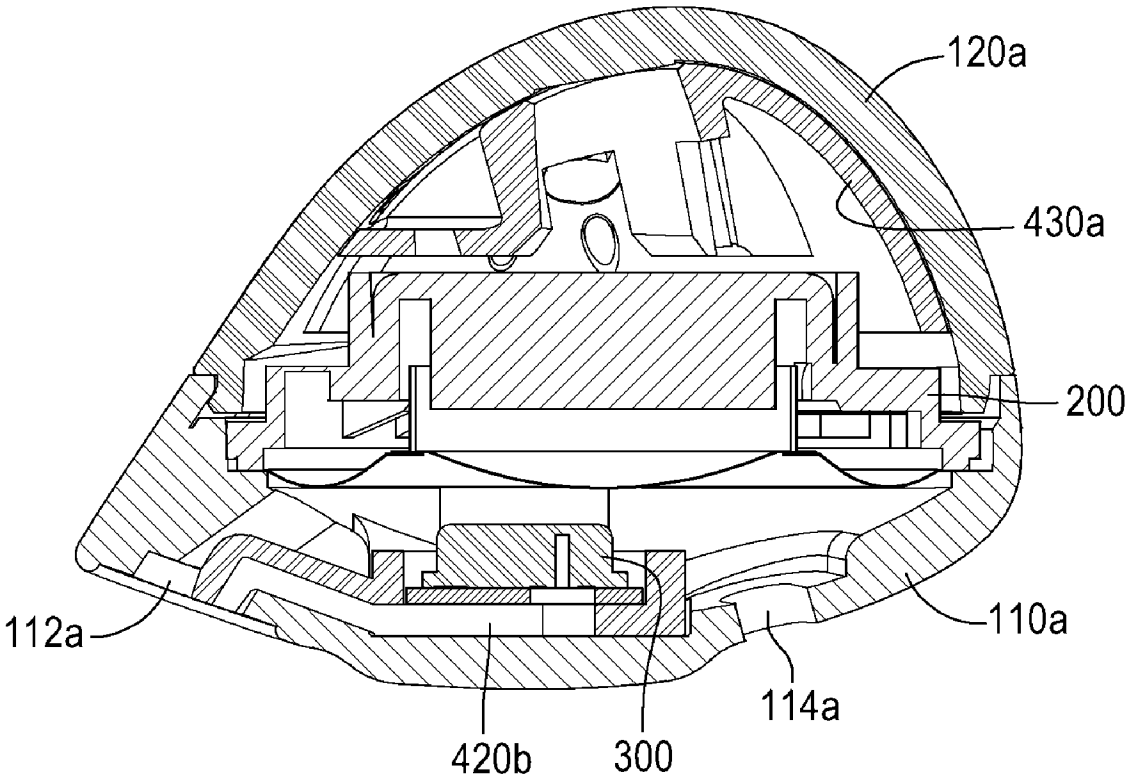
FIG. 7 is a cross-sectional view of an earset according to a third embodiment.

FIG. 7 is a cross-sectional view of an earset according to a third embodiment.

The earset according to the third embodiment is identical to that of the second embodiment, except that a duct 420*b* connecting the inner microphone 300 and the first sound emitting hole 112*a* bends and extends into the first sound emitting hole 112*a*. As the duct 420*b* bends into the first sound emitting hole 112*a*, it is possible to reduce howling sounds that might arise during phone calls.

An earset provided according to the embodiments described herein is able to suppress external noise, because it is configured to feed sounds coming from the Eustachian tube into a microphone through an audio microphone duct formed in a sound emitting hole.

Moreover, it is possible to reduce howling that might arise during phone calls by fabricating and mounting a duct 420*b* that extends into the sound emitting hole and directs sounds.

Additionally, a structure with an audio microphone duct formed in the sound emitting hole is applicable to a canal-type earset and an open-type earset. Besides, it may be applicable to a wireless earset and a TWS earset.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An open-type earset, comprising:

a housing including a front housing facing an ear of a user and a rear housing facing away from the ear of the user and that define a mounting space in which components are mounted and form an exterior of the open-type earset, wherein the front housing has one or more sound emitting holes and the rear housing has a back hole for enabling communication between an inside of the housing and the outside, wherein the one or more sound emitting holes includes a first sound emitting hole of relatively large size and configured to output sounds to an external auditory canal of the user and a second sound emitting hole of relatively small size, in comparison to the first sound emitting hole, configured to tune mid-frequency sound pressure flat in an area external to the earset;

a sound reproducing unit mounted in the mounting space and configured to emit sounds through the one or more sound emitting holes;

an inner microphone mounted between the sound reproducing unit and the front housing, in the mounting space; and a duct mounted in the front housing and configured to transmit sounds coming through the one or more sound emitting holes to the inner microphone.

2. The open-type earset of claim 1, wherein the duct extends into at least one of the one or more sound emitting holes.

3. The open-type earset of claim 1, wherein an angle between a sound emitting direction of the first sound emitting hole and a sound emitting direction of the second sound emitting hole are both is 90 degrees or more.

4. The open-type earset of claim 1, wherein the inner microphone communicates with the first sound emitting hole through the duct such that when the user speaks, a voice of the user enters the first sound emitting hole through the Eustachian tube and is transmitted to the inner microphone through the duct.

5. The open-type earset of claim 1, further comprising:

a bracket mounted between the rear housing and the sound reproducing unit; and a bracket duct that communicates the mounting space with the back hole.

6. The open-type earset of the claim 5, wherein the bracket covers the back hole to form the bracket duct and the bracket includes a communicating hole spaced apart from the back hole of the rear housing.

* * * * *